US009601886B1

(12) United States Patent
Fransen et al.

(10) Patent No.: US 9,601,886 B1
(45) Date of Patent: Mar. 21, 2017

(54) COMMUNICATION PLUGS AND COMPONENTS THEREOF

(71) Applicant: Panduit Corp., Tinley Park, IL (US)

(72) Inventors: Robert E. Fransen, Tinley Park, IL (US); Joshua A. Valenti, Wheeling, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 15/050,573

(22) Filed: Feb. 23, 2016

(51) Int. Cl.

| | |
|---|---|
| ***H01R 4/50*** | (2006.01) |
| ***H01R 24/64*** | (2011.01) |
| ***H01R 13/6466*** | (2011.01) |
| *H01R 107/00* | (2006.01) |

(52) U.S. Cl.
CPC ..... *H01R 24/64* (2013.01); *H01R 13/6466* (2013.01); *H01R 2107/00* (2013.01)

(58) Field of Classification Search
CPC H01R 24/64; H01R 13/6658; H01R 13/6469; H01R 24/62; H01R 13/26; H01R 13/506
See application file for complete search history.

(56) References Cited

U.S. PATENT DOCUMENTS

| | | | | |
|---|---|---|---|---|
| 7,815,462 | B2 * | 10/2010 | Boeck | H01R 4/2433 439/409 |
| 8,591,248 | B2 * | 11/2013 | Pepe | H01R 13/6461 439/405 |
| 8,647,146 | B2 * | 2/2014 | Bopp | H01R 13/6466 439/404 |
| 8,690,598 | B2 * | 4/2014 | Bolouri-Saransar | H01R 13/6469 439/404 |
| 8,870,589 | B2 * | 10/2014 | Su | H01R 4/2404 439/404 |

* cited by examiner

*Primary Examiner* — Xuong Chung Trans
(74) *Attorney, Agent, or Firm* — Christopher Clancy; James Williams; Yuri Astvatsaturov

(57) ABSTRACT

The present invention generally relates to the field of network communication, and more specifically, to the field of communication plugs used in network connectivity. In an embodiment, the present invention is a communication connector that includes: a housing; a printed circuit board (PCB) assembly positioned inside of the housing, the PCB assembly including a first PCB and a second PCB, the PCB assembly further including a plurality of vias, each of the vias extending at least partially through both of the first PCB and the second PCB; and a plurality of plug contacts, each of the plug contacts including an interface section and a base section, the base section being positioned inside one of the vias.

16 Claims, 13 Drawing Sheets

COMMUNICATION PLUGS AND COMPONENTS THEREOF

FIELD OF INVENTION

The present invention generally relates to the field of network communication, and more specifically, to the field of communication plugs used in network connectivity.

BACKGROUND

In network communication, standards are often used to define a particular set of electronic parameters in an effort to provide users with non-proprietary standard platform for connectivity hardware. One such example is the ANSI/TIA-568-C.2 standard provided by TIA which specifies the necessary amount of crosstalk (near end crosstalk (NEXT) and far end crosstalk (FEXT)) that is required to be generated by an RJ45 plug. While achieving each of these parameters alone can be relatively straight forward, meeting all the requirements simultaneously can be quite challenging.

For instance, for a given plug, NEXT is proportional to the sum of the capacitive and inductive crosstalk elements, while FEXT is proportional to the difference between the capacitive and inductive crosstalk elements. The more inductive crosstalk that is present within the body of the plug, the less capacitive crosstalk can be placed at the nose of the plug between the plug contacts while still satisfying the TIA NEXT and FEXT requirements. Therefore, the effective distance between the crosstalk and compensation (typically located in a corresponding jack) will increase as the amount of inductive crosstalk within the plug body increases. Conversely, decreasing the amount of inductive crosstalk within the plug body will support a design with more crosstalk between the plug contacts at the nose of the plug, thereby decreasing the distance between the crosstalk and compensation. However, some levels of inductive crosstalk must be maintained in order to meet the FEXT requirements.

Furthermore, due to manufacturing tolerances, certain plug designs are more susceptible to parameter fluctuations which may prevent proper operation within the specifications required by a particular standard.

These and other concerns create the need for continued improvements in network communication plug designs.

SUMMARY

Accordingly, at least some embodiments of the present invention are directed towards communication plug designs which enable improved performance tuning.

In an embodiment, the present invention is a communication connector that includes: a housing; a printed circuit board (PCB) assembly positioned inside of the housing, the PCB assembly including a first PCB and a second PCB, the PCB assembly further including a plurality of vias, each of the vias extending at least partially through both of the first PCB and the second PCB; and a plurality of plug contacts, each of the plug contacts including an interface section and a base section, the base section being positioned inside one of the vias.

These and other features, aspects, and advantages of the present invention will become better-understood with reference to the following drawings, description, and any claims that may follow.

DETAILED DESCRIPTION

Figure 1:
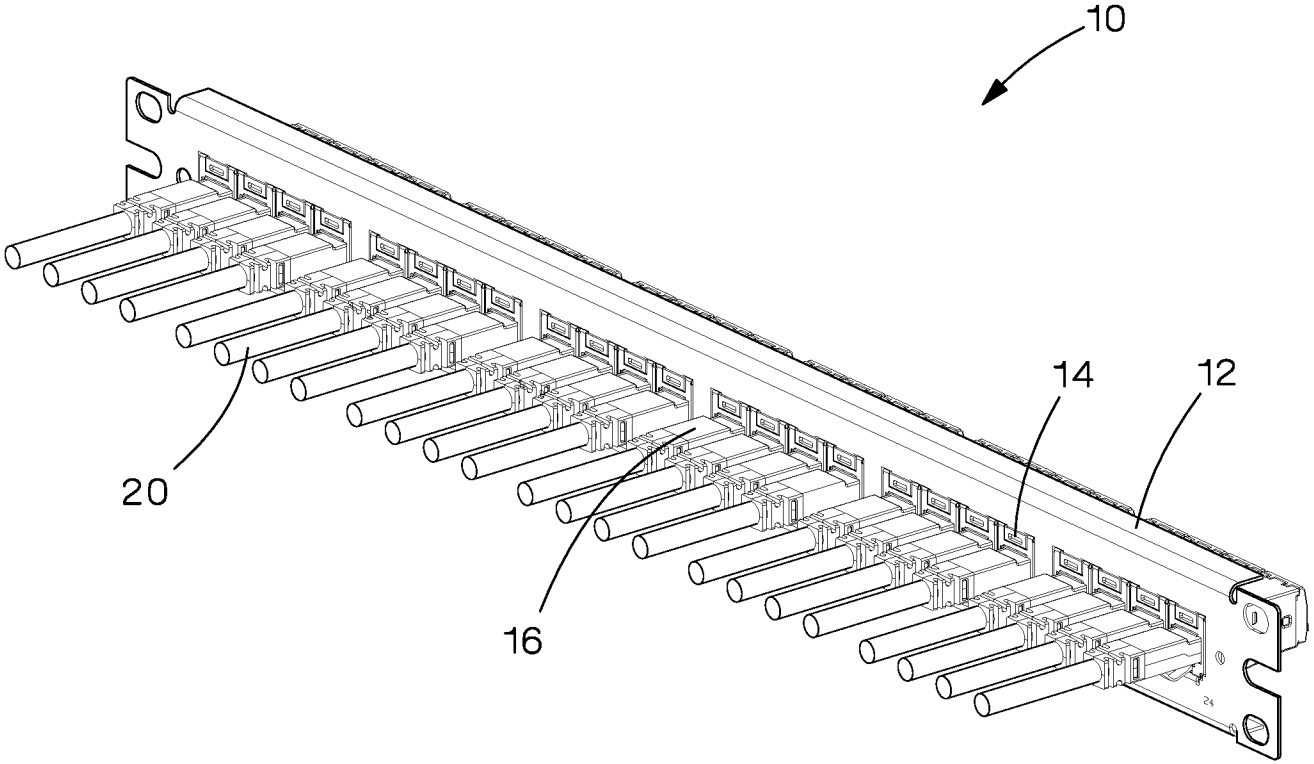
FIG. 1 illustrates a communication system according to an embodiment of the present invention.

FIG. 1 illustrates a communication system 10 according to an embodiment of the present invention which includes patch panel 12 with jacks 14 and corresponding plug assemblies 16. Respective cables 20 are terminated to plug assemblies 16. Once a plug assembly 16 mates with a jack 14 data can flow in both directions through these connectors. Although communication system 10 is illustrated as a patch panel in FIG. 1, alternatively it can include other active or passive equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers and/or telecommunications rooms; security devices (cameras and other sensors, etc.) and door access equipment; and telephones, computers, fax machines, printers and other peripherals as can be found in workstation areas. Communication system 10 can further include cabinets, racks, cable management and overhead routing systems, and other such equipment.

Figure 2:
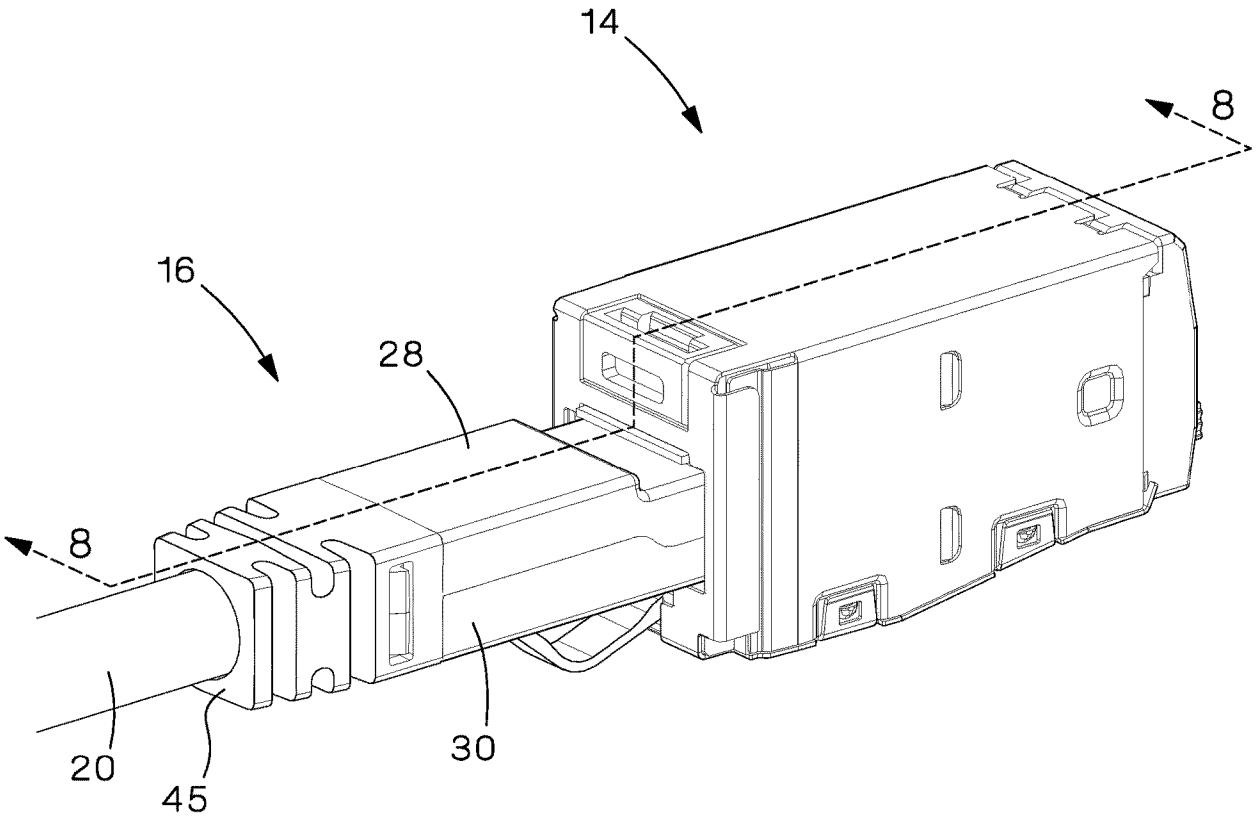
FIG. 2 illustrates a mated plug/jack assembly.
Figure 3:
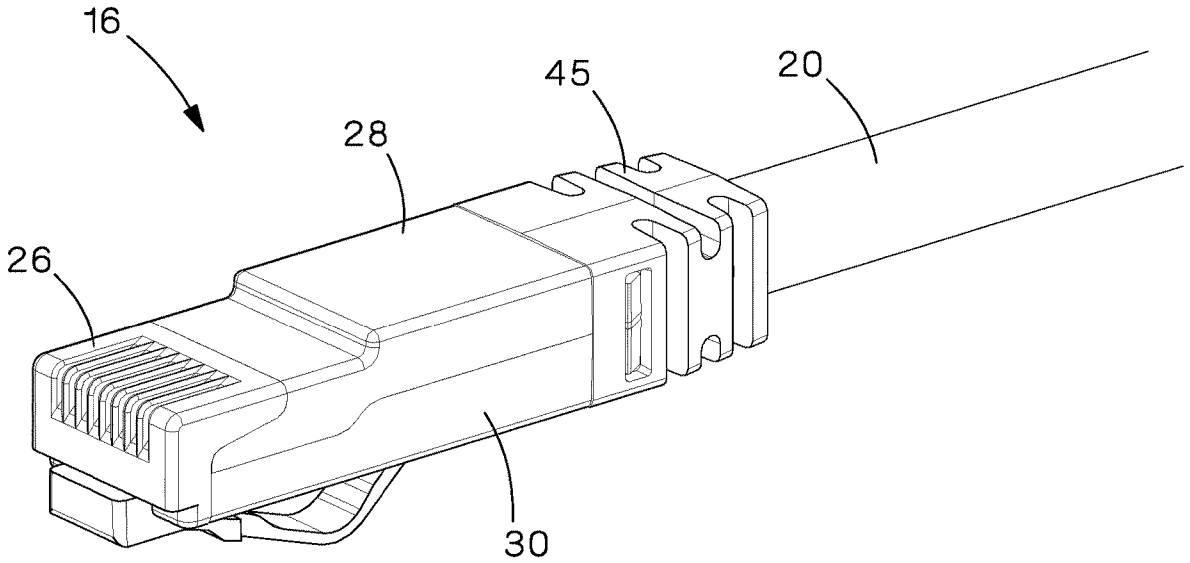
FIGS. 3 and 4 illustrate isometric views of a communication plug according to an embodiment of the present invention.
Figure 4:
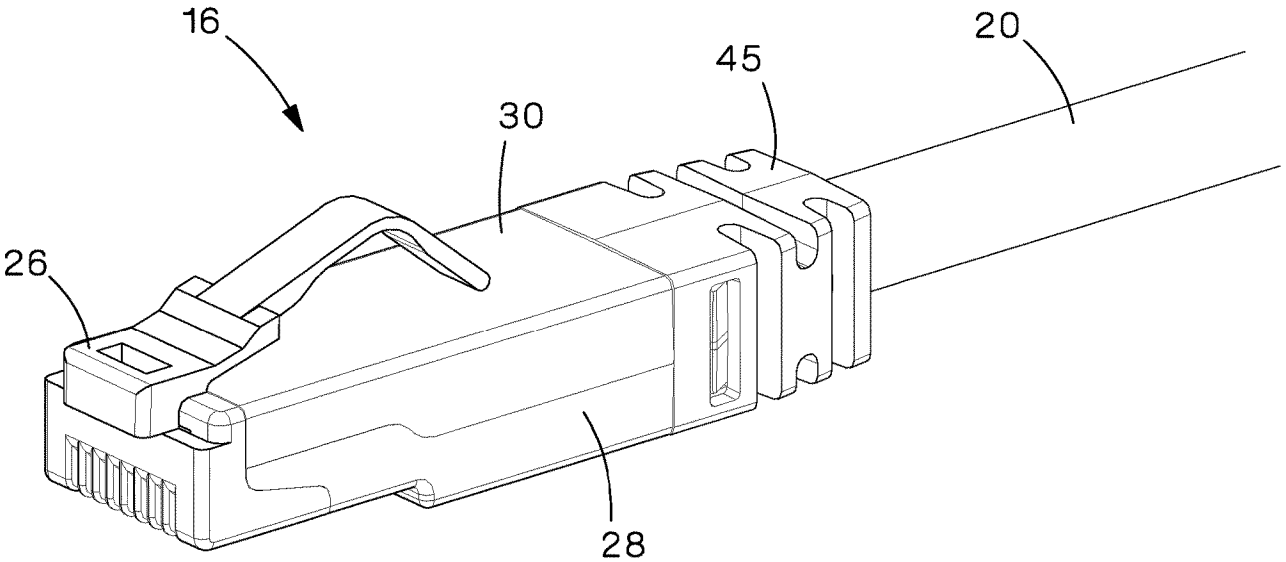

With the patch panel 12 removed, FIG. 2 illustrates the network jack 14 and the RJ45 plug assembly 16 in a mated configuration, and FIGS. 3-4 illustrate the network RJ45 plug assembly 16 by itself with FIG. 4 being rotated 180° about the central axis of cable 20 relative to FIG. 3.

Figure 5:
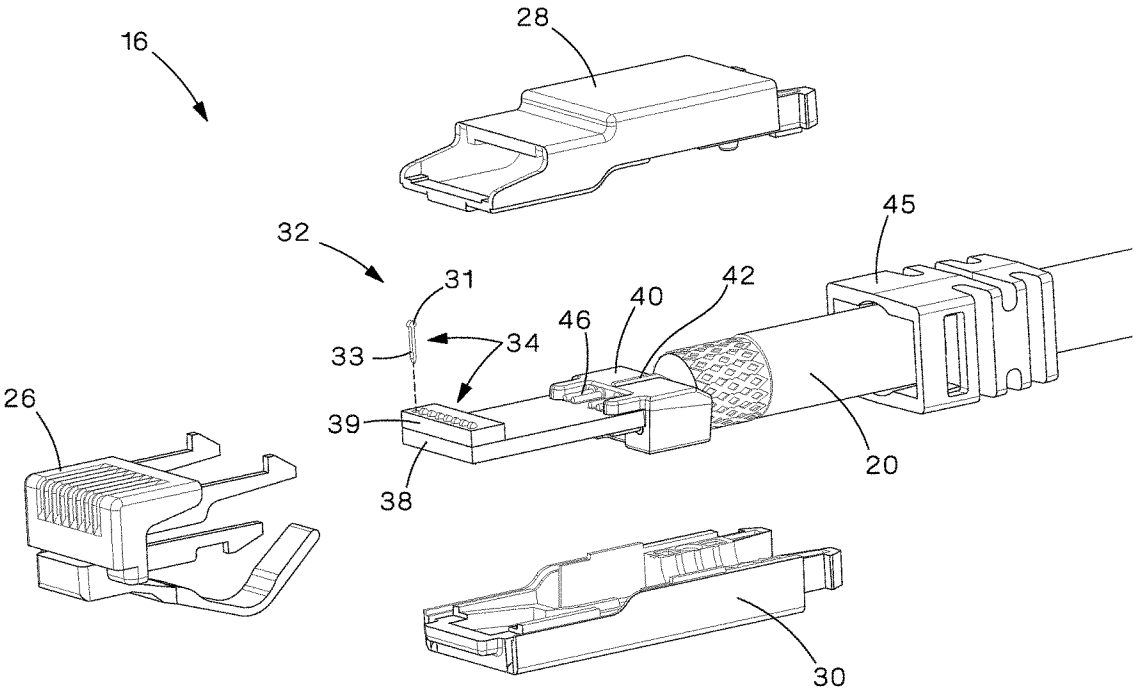
FIGS. 5 and 6 illustrate isometric exploded views of the communication plug according to an embodiment of the present invention.
Figure 6:
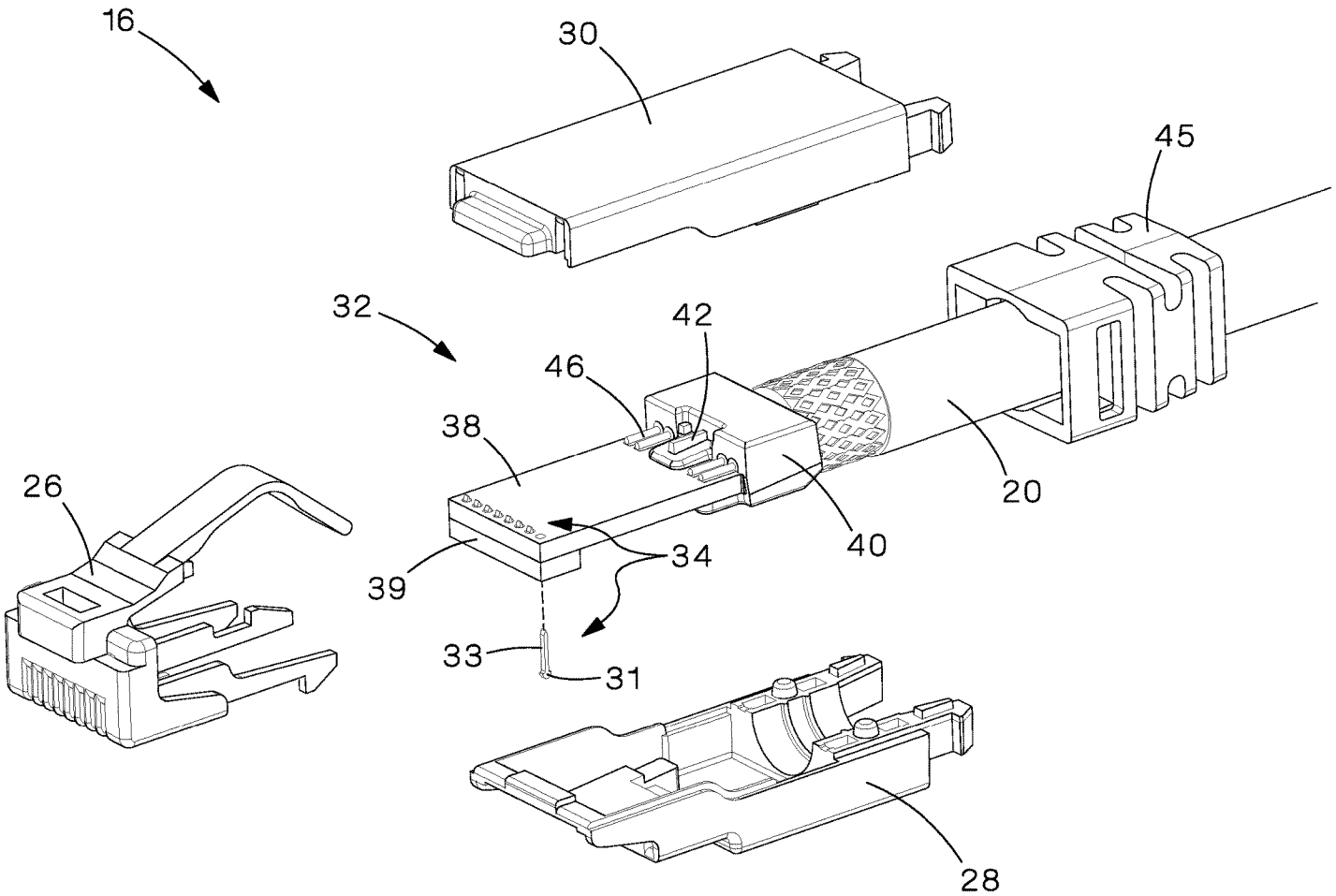

As shown in the exploded views of the plug 16 in FIGS. 5 and 6, the plug includes non-conductive front housing 26, top shell 28, bottom shell 30, PCB assembly 32 (which includes plug contacts 34 [each having an interface section 31 and a base section 33], first PCB 38, second PCB 39, cable over molding 40, and conductive pair manager 42) and bend radius control boot 45. Plug 16 can be used to terminate cable 20 as shown in the figures.

During the assembly, bend radius control boot 45 is positioned over cable 20. Then the cable is dressed such that each conductor 46 pair is positioned in separate electrically isolated quadrants on conductive pair manager 42. Then conductors 46 of cable 20 are attached to first PCB 38 through pads 60 (illustrated more clearly in FIG. 7). Conductors 46 are shown attached to first PCB 38 through a soldered connection; however other non-limiting means of connecting conductors to a PCB may be used.

Figure 7:
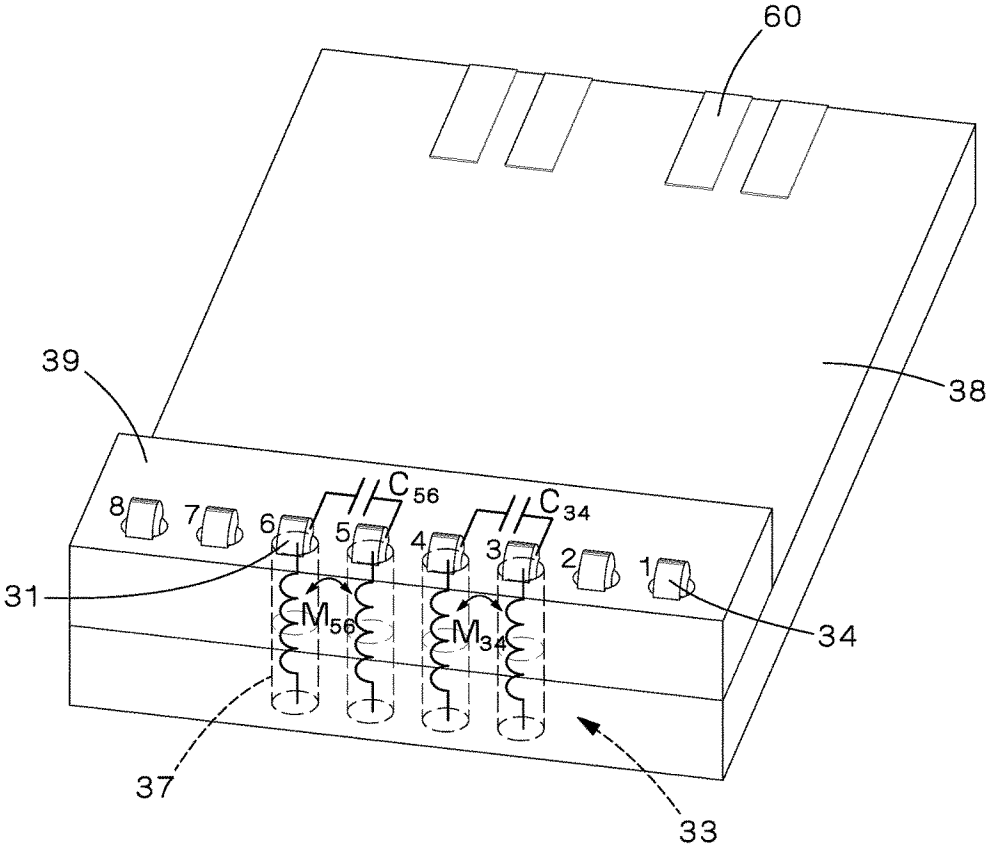
FIG. 7 illustrates a front isometric view of a printed circuit board (PCB) assembly shown in FIGS. 5 and 6.
Figure 8:
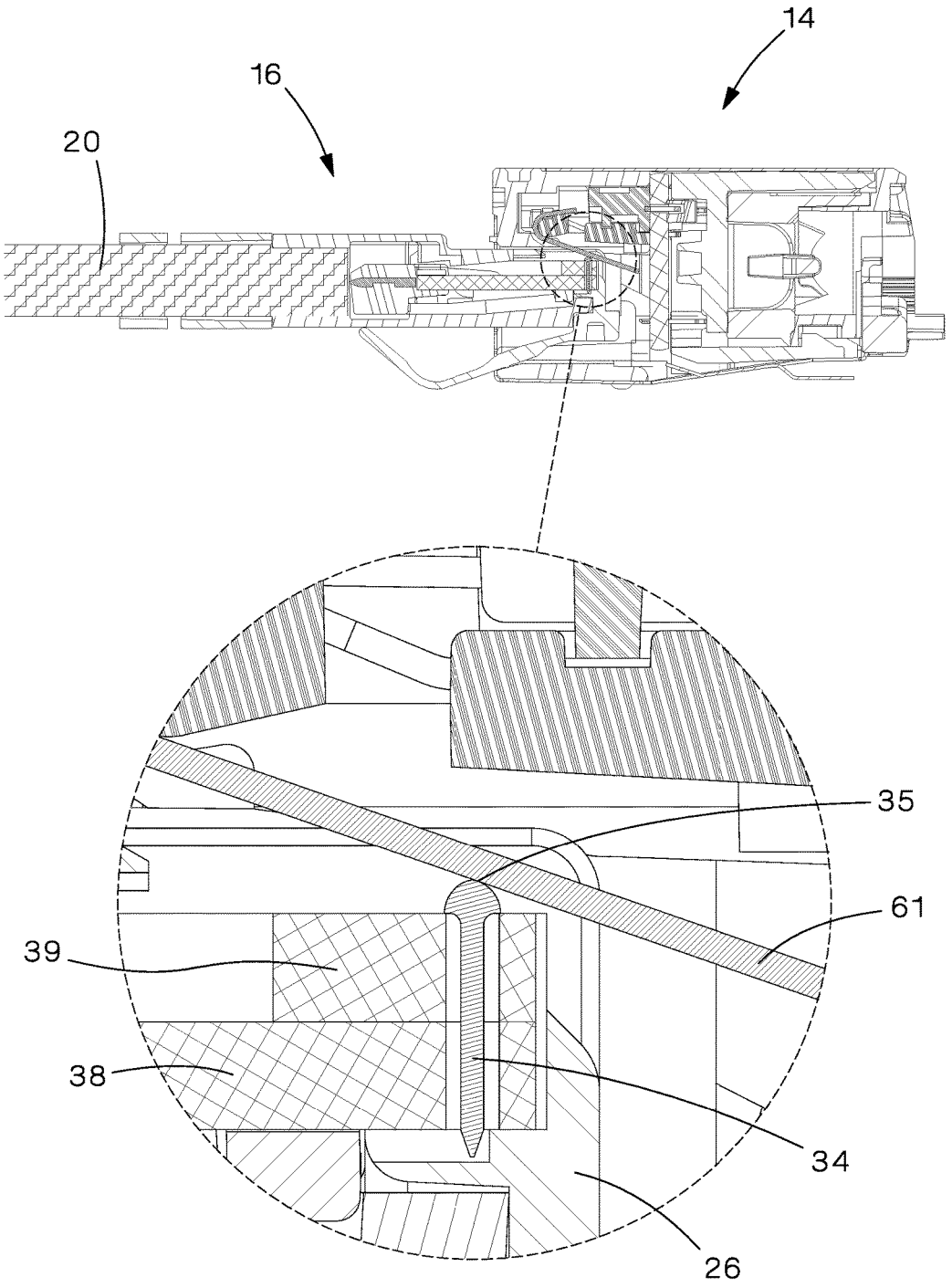
FIG. 8 is a cross-section view taken across the section line 8-8 of FIG. 2.

FIG. 7 is a front isometric view of PCB assembly 32. Plug contacts 34 mechanically and electrically join first PCB 38 to second PCB 39 by plated through hole vias 37. Each of the plug contacts is positioned such that its base section 33 extends into a respective via (traversing the first and second PCBs) with the interface section 31 remaining exposed in order to make contact with plug interface contacts of a corresponding jack through the mating interface 35. Plug contacts 34 are designed to be small in profile so as to reduce electromagnetic coupling between any one plug contact 34 and the remaining seven plug contacts 34. Plug contacts 34 are also designed to be small in profile to keep a short distance between second PCB 39 and the mating interface 35 between plug contact 34 and jack contact 61 (see FIG. 8 which is a cross-section view taken along section line 8-8 of FIG. 2). Given the low profile of the plug contacts, there may not be enough electromagnetic coupling between neighboring plug contacts 34 and vias 37 to have an RJ45 plug compliant to the crosstalk magnitude requirement of ANSI/TIA-568-C.2. Therefore, additional crosstalk coupling may need to be inserted into first PCB 38 and/or second PCB 39. It is desirable to locate the crosstalk coupling loads as close to mating interface 35 as possible to reduce the distance to the crosstalk cancellation circuitry that will likely be implemented in a corresponding jack 14.

FIG. 7 schematically shows the additional crosstalk circuitry for pairs 4:5-3:6. However, similar coupling can be added for the remaining pair combinations. Additional capacitive coupling C34 is added second to PCB 39 between plug contact 3 and plug contact 4 (note that the numbering of plug contacts is consistent with plug contact numbering provided by ANSI/TIA-568-C.2, which is incorporated herein by reference in its entirety). Capacitor C34 can be a discrete capacitor, an embedded capacitor designed into one or more layers on PCB 39, or generated by some other non-limiting means such as distributed capacitance. To locate capacitor C34 close to mating interface 35, capacitor C34 is on the top layer(s) of second PCB 39 (visible layer of FIG. 7). It is also shown to be positioned outside of the transmission line current path. Capacitor C56 is added to second PCB 39 between plug contact 5 and plug contact 6. Its magnitude is approximately the same as capacitor C34 in order to maintain a balanced load.

To meet the ANSI/TIA-568-C.2 FEXT requirements, there must exist a level of inductive coupling in addition to the capacitive coupling. In the present embodiment inductive coupling M34 occurs between vias 37 of plug contact 3 and plug contact 4. During operation, current travels between pads 60 and mating interface 35, passing through vias 37 and plug contacts 34. This current creates the magnetic field that couples to the neighboring transmission lines. Similar to the capacitive coupling, it is still desirable to have the inductive coupling occur close to mating interface. The amount of inductive coupling can be adjusted to a desired level by a variety of ways, including adjusting the diameter of vias, adjusting the thickness of first PCB 38 and second PCB 39, adjusting the spacing of vias, or other non-limiting means. Inductive coupling M56 occurs similarly between vias 37 of plug contact 5 and plug contact 6. The relative closeness of the RJ45 plug's inductive and capacitive coupling to mating interface 35 aids in meeting the NEXT and FEXT requirements when mated with jack 14.

Using the described two-PCB layout to create PCB assembly 32 may yield certain cost benefits. For example, first PCB 38 can be fabricated from a two-layer stack-up as its purpose can be to transfer the differential signals from pads 60 to vias 37 with minimal crosstalk coupling. On the other hand, second PCB 39 can be fabricated with a four (or more) layer stack-up in order to lump the capacitive coupling elements close to plug contacts 34 and mating interface 35. It may be cost justified to make the larger PCB 38 out of a lower cost two-layer stack-up and the smaller PCB 39 out of a higher cost four (or more) layer stack-up.

Figure 9:
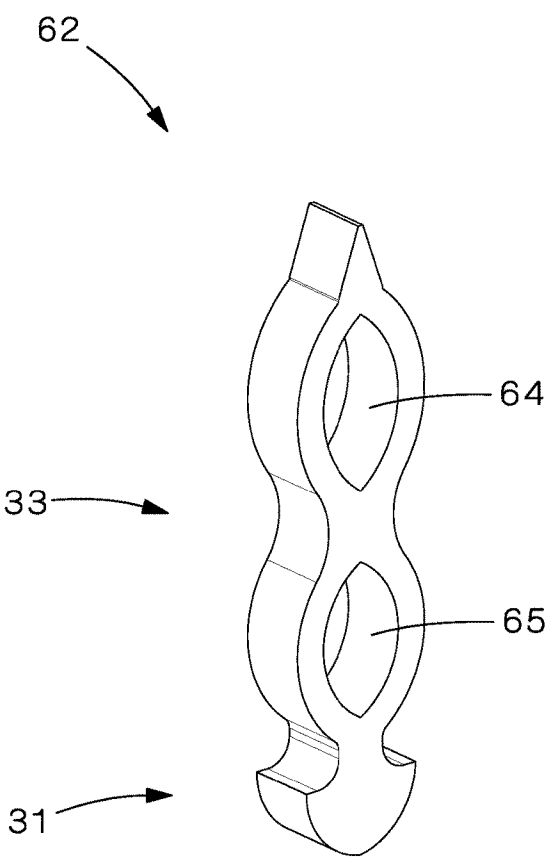
FIG. 9 is an isometric view of a plug contact according to an embodiment of the present invention.

FIGS. 9-17 illustrate alternative plug contact embodiments which may be used within communication plug 16. FIG. 9 is a front isometric view of plug contact 62 with stacked compliant sections 64 and 65. Sections 64 and 65 could be same or different dimensions. One of ordinary skill in the art will recognize that vias 37 will need to be sized appropriately to accept the compliant sections 64. In an embodiment where compliant sections 64 and 65 are non-equal in their dimensions, it is preferable to have section 65 be larger than section 64. This may allow for easier installation as section 64 will pass with greater ease through the larger via of PCB 39.

Figure 10:
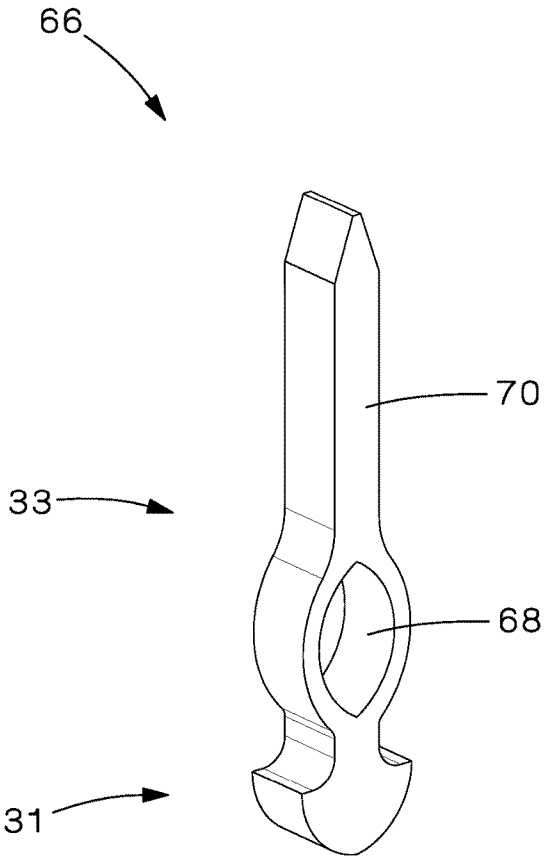
FIG. 10 is an isometric view of a plug contact according to an embodiment of the present invention.

FIG. 10 is a front isometric view of plug contact 66, which has compliant section 68 and straight section 70. The orientation of compliant section 68 and straight section 70 can be reversed such that in an alternate embodiment compliant section 68 made electrical contact with PCB 38 and straight section 70 made electrical contact with PCB 39.

Figure 11:
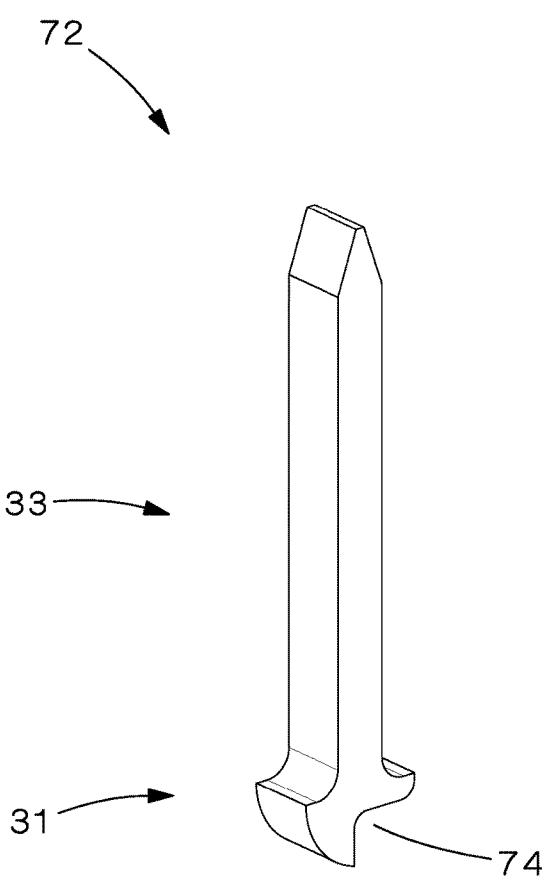
FIG. 11 is an isometric view of a plug contact according to an embodiment of the present invention.

FIG. 11 is a front isometric view of plug contact 72 which includes an L-shaped cutout 74. This configuration may be helpful in reducing the cross section area of the plug contact in an attempt to reduce the capacitive coupling between adjacent plug contacts.

Figure 12:
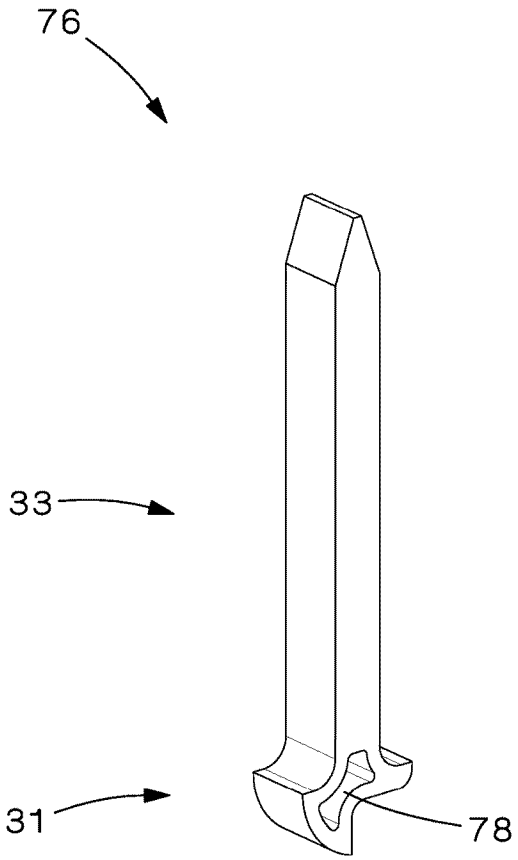
FIG. 12 is an isometric view of a plug contact according to an embodiment of the present invention.

FIG. 12 shows a modified embodiment of the plug contact shown in FIG. 11. In this case, in addition to having the external L-shaped cutout, plug contact 76 includes an interior cutout (slot) 78 which further reduces the contact's cross-section area. The cutout 78 essentially hollows out a portion of the plug contact. Note that as used herein, references to an "interior cutout" indicate that the hollow area is surrounded by the plug contact along some perimeter.

Figure 14:
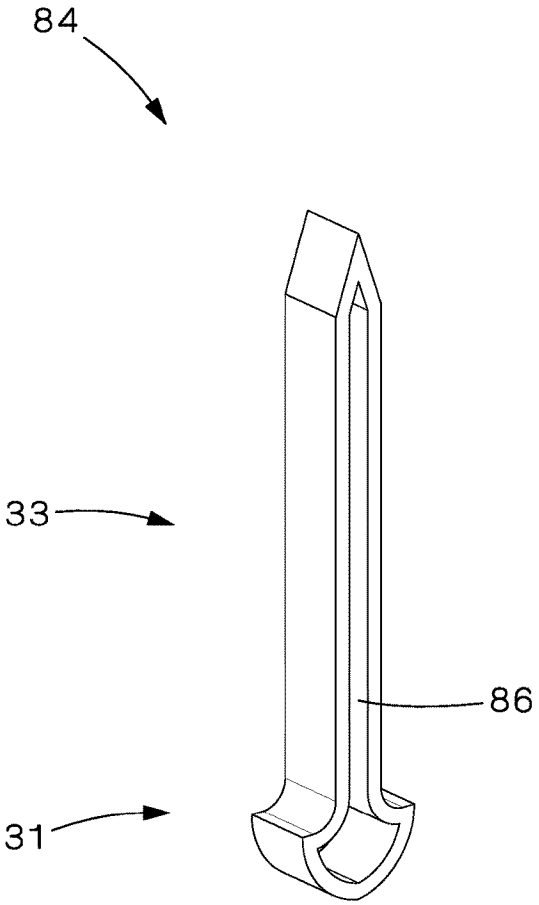
FIG. 14 is an isometric view of a plug contact according to an embodiment of the present invention.
Figure 13:
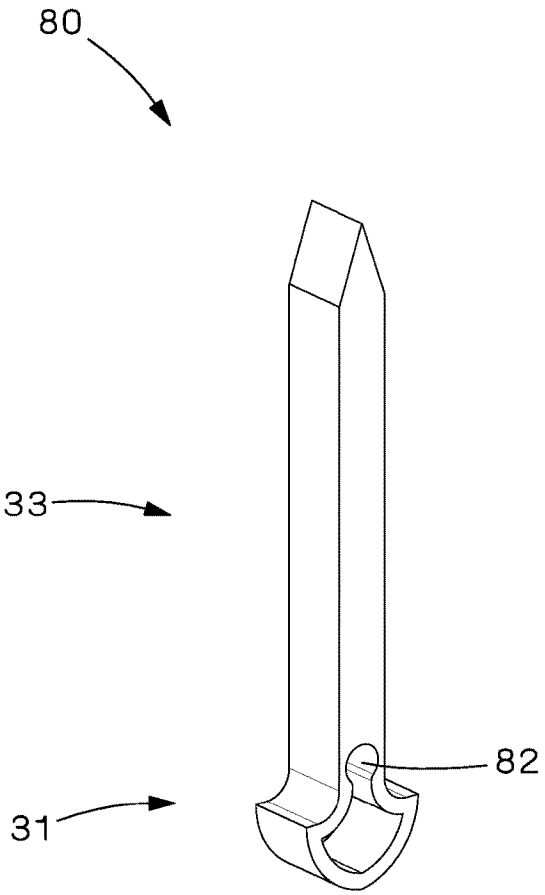
FIG. 13 is an isometric view of a plug contact according to an embodiment of the present invention.

FIGS. 13 and 14 illustrate additional embodiments of plug contacts with interior cutouts. FIG. 13 is a front isometric view of plug contact 80 that includes slot 82 that extends inside the via of PCB 39 but does not extend down to PCB 38. FIG. 14 is a front isometric view of plug contact 84 that includes slot 86 that extends inside of both PCB 38 and PCB 39.

Figure 15:
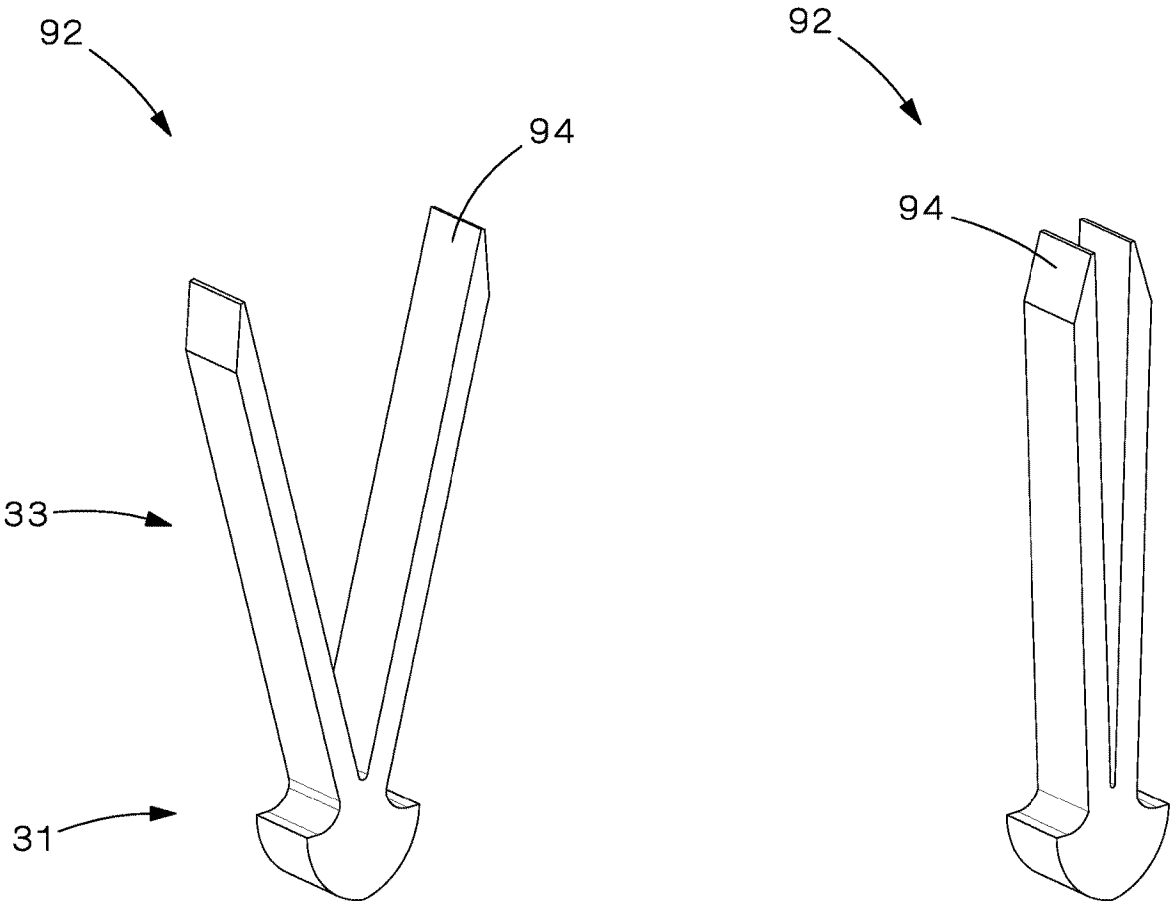
FIG. 15 is an isometric view of a plug contact according to an embodiment of the present invention.
Figure 16:
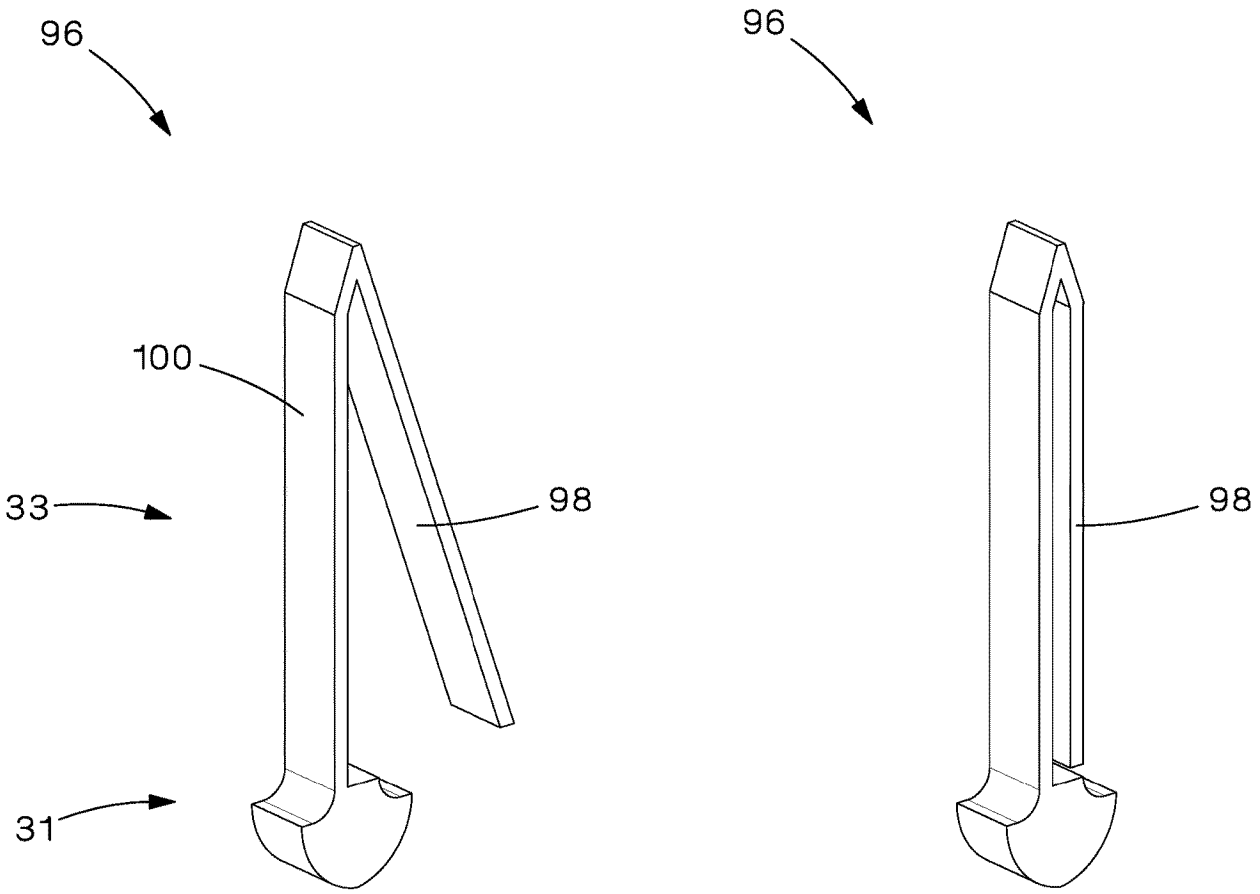
FIG. 16 is an isometric view of a plug contact according to an embodiment of the present invention.

FIGS. 15 and 16 illustrate yet additional embodiments of plug contacts. These embodiments are directed towards providing compression during installation without the usage of compliant pins. FIG. 15 is a front isometric view of plug contact 92 that includes arms 94 that flex outward after installation to ensure contact with both PCB 38 and PCB 39. In this embodiment, the hinging section which links both arms is located at the end of the plug contact that is proximate the mating section. FIG. 16 is a front isometric view of plug contact 96 that includes arm 98 that flexes outward and away from the base 100 after installation to ensure contact with both PCB 38 and PCB 39. In this embodiment, the hinging section which links both the arm 98 and the base 100 is located at the end of the plug contact that is opposite of the end with the mating section. Although both plug contact 92 and 96 apply pressure during installation for added electrical reliability, soldering or other non-limiting connection methods may be used as well.

Note that while this invention has been described in terms of several embodiments, these embodiments are non-limiting (regardless of whether they have been labeled as exemplary or not), and there are alterations, permutations, and equivalents, which fall within the scope of this invention. For example, while references have been made to rigid PCBs, one of ordinary skill in the art would recognize that the use of flexible PCBs or combinations of flex/rigid PCBs would also be within the scope of the disclosure. Moreover, those of ordinary skill will recognize that embodiments of the present invention can be applied to and/or implemented in a variety of shielded communications cables, including without limitation CAT5E, CAT6, CAT6A, CAT7, CAT8, and other twisted pair Ethernet cable, as well as other types of cable. Furthermore, it should be understood that various plug contact designs are not limited to working only with the circuit board designs/configurations described herein, and may instead be implemented in any variety of other connectors. Additionally, the described embodiments should not be interpreted as mutually exclusive, and should instead be understood as potentially combinable if such combinations are permissive. It should also be noted that there are many alternative ways of implementing the methods and apparatuses of the present invention. It is therefore intended that claims that may follow be interpreted as including all such alterations, permutations, and equivalents as fall within the true spirit and scope of the present invention.

We claim:

1. A modular plug connector comprising:

a housing;

a printed circuit board (PCB) assembly positioned inside of said housing, said PCB assembly including a first PCB and a second PCB, said PCB assembly further including a plurality of vias, each of said vias extending at least partially through both of said first PCB and said second PCB; and a plurality of plug contacts, each of said plug contacts including an interface section and a base section, said base section being positioned inside one of said vias.

2. The modular plug connector of claim 1, wherein said first PCB has a two layer stack-up configuration, and wherein said second PCB is a greater than two layer stack-up configuration.

3. The modular plug connector of claim 1, wherein said first PCB is immediately adjacent to said second PCB.

4. The modular plug connector of claim 1, wherein each of said base sections includes a first compliant section and a second compliant section.

5. The modular plug connector of claim 4, wherein said first compliant section is positioned within said first PCB and said second compliant section is positioned within said second PCB.

6. The modular plug connector of claim 1, wherein each of said base sections includes a compliant section and a straight section, said compliant section being positioned between said straight section and said interface section.

7. The modular plug connector of claim 6, wherein said straight section is positioned within said first PCB and said compliant section is positioned within said second PCB.

8. The modular plug connector of claim 1, wherein each of said plug contacts includes an interior cutout.

9. The modular plug connector of claim 8, wherein said interior cutout is positioned within at least one of said interface section and said base section.

10. The modular plug connector of claim 1, wherein for each of said plug contacts respective said interface section includes a mating interface positioned along a curved surface and an L-shaped cutout section.

11. The modular plug connector of claim 1, wherein for each of said plug contacts respective said base section includes a first arm and a second arm, said first arm and said second arm being hingedly attached to each other proximate respective said interface section.

12. The modular plug connector of claim 11, wherein said first arm and said second are springingly compressible.

13. The modular plug connector of claim 1, wherein for each of said plug contacts respective said base section includes a base and an arm, said arm being hingedly attached to said base.

14. The modular plug connector of claim 13, wherein said arm is hingedly attached to said base distal said interface section.

15. The modular plug connector of claim 13, wherein said arm is springingly attached to said base.

16. A communication connector comprising:

a housing;

a printed circuit board (PCB) assembly positioned inside of said housing, said PCB assembly including a first PCB and a second PCB, said PCB assembly further including a plurality of vias, each of said vias extending at least partially through both of said first PCB and said second PCB; and a plurality of plug contacts, each of said plug contacts including an interface section and a base section, said base section being positioned inside one of said vias.

* * * * *